US008286967B2

(12) United States Patent
Sparago

(10) Patent No.: US 8,286,967 B2
(45) Date of Patent: Oct. 16, 2012

(54) CRAPS-BASED SIDE WAGER FOR BLACKJACK CARD GAME

(75) Inventor: Merrill Sparago, Los Angeles, CA (US)

(73) Assignee: Score Gaming LLC, Los Angeles, CA (US)

( * ) Notice: Subject to any disclaimer, the term of this patent is extended or adjusted under 35 U.S.C. 154(b) by 26 days.

(21) Appl. No.: 13/097,225

(22) Filed: Apr. 29, 2011

(65) Prior Publication Data

US 2011/0266747 A1 Nov. 3, 2011

Related U.S. Application Data

(60) Provisional application No. 61/329,330, filed on Apr. 29, 2010.

(51) Int. Cl.
*A63F 1/001* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 5,669,606 | A | 9/1997 | Brown | |
| 5,695,192 | A | 12/1997 | Brown | |
| 5,758,878 | A | 6/1998 | Brown | |
| 5,782,472 | A | 7/1998 | Brown | |
| 5,842,698 | A | 12/1998 | Brown | |
| 5,857,676 | A | 1/1999 | Whitson | |
| 5,924,926 | A | 7/1999 | Brown | |
| 5,961,119 | A * | 10/1999 | Brown | 273/292 |
| 6,019,373 | A | 2/2000 | Brown | |
| 6,123,335 | A | 9/2000 | Adkins | |
| 6,692,003 | B2 | 2/2004 | Potter et al. | |
| 6,708,974 | B1 | 3/2004 | Brown, III | |
| 7,144,012 | B2 * | 12/2006 | Grigsby | 273/292 |
| 7,419,162 | B2 | 9/2008 | Lancaster et al. | |
| 2005/0093240 | A1 | 5/2005 | Jones et al. | |
| 2005/0212213 | A1 | 9/2005 | Inglese | |
| 2009/0270154 | A1 * | 10/2009 | Jennings | 463/16 |

* cited by examiner

*Primary Examiner* — Michael Dennis
(74) *Attorney, Agent, or Firm* — Endurance Law Group PLC

(57) ABSTRACT

A card game of Blackjack including a novel side wager. If a Player has made the side wager, two dice are rolled. If the sum of the two rolled dice is 2, 3 or 12, the side bet is automatically lost similar to the Come-Out roll in the game of craps. If the dice sum is 7 or 11, the side bet is automatically won. If the dice sum is anything other, a Point is established. As in traditional Blackjack, each Player is dealt two cards face up, and the Dealer is dealt two cards—one face up. A Player wins the side bet if one of their dealt cards has a face value equal to the Point, or if the sum of their dealt cards equals the Point. Several variations on the basic game method are described. According to one variation, the side wager is resolved uniformly for all Players that have made the optional side wager based on the Dealer's initial up card or on the Dealer's first two cards when both are revealed. The invention may be implemented as a live table game in conjunction with the card game Blackjack, or in electronic implementations were the cards, playing surface, and dice are simulated on a display screen through the action of a non-transitory computer readable medium coded with instructions and executed by a processor.

3 Claims, 12 Drawing Sheets

Double Card Bonus

Player

Side Wager
BONUS WIN

Double Dice Bonus

Player

Side Wager
BONUS WIN

Seven-Card Bonus

Player

Side Wager
AUTOMATIC WIN + BONUS

CRAPS-BASED SIDE WAGER FOR BLACKJACK CARD GAME

CROSS REFERENCE TO RELATED APPLICATIONS

This application claims priority to U.S. Provisional patent application No. 61/329,330 filed Apr. 29, 2010.

BACKGROUND OF THE INVENTION

1. Field of the Invention

This invention relates generally to a method for playing a Blackjack card game, and more specifically to a side wager for the card game having elements of the traditional dice game known as craps.

2. Related Art

Blackjack, also known as Twenty-One or by various other names, is a popular card game, often quoted as the most widely played casino banked game in the world. The traditional game is played with one or more standard decks of playing cards. At the beginning of each round, the player places a bet and receives an initial hand of two cards. The basic rules of the game involve adding the value of the two initial card hand in hopes of being dealt a value of 21. If a value of less than 21 is dealt, the player may choose to be dealt single cards until they either reach a value of 21, or reach a lesser value the player feels comfortable holding at, or reach a value that exceeds 21. As between each player and the Dealer independently, the winner holds a hand with a value of or nearest to 21 without exceeding it. The complete rules of play for Blackjack are well documented and well known to those in the gaming field.

The gaming industry is in constant pursuit of new gaming methods as well as modifications to existing gaming methods that will attract new players and maintain the interest of current players. One such technique found effective in many game scenarios is the use of an optional side wager. Side wagers are typically made and resolved while the normal game play is temporarily suspended. Various types of side wagers for games such as slots and Poker have proven moderately successful to capture player interest. However, with respect to the game of Blackjack specifically, craps based side wagers have not been applied with much effectiveness. Examples of some attempted side wagers include U.S. Pat. No. 5,695,192 to Brown which describes a Blackjack game having a craps-based side bet. According to this game method, a player must achieve a qualified hand before they become eligible for the optional side wager. Brown suggests a predetermined two-card combination in order to become eligible for participating in the craps-based side bet. In the preferred embodiment of this game, each player having a Blackjack and beating the Dealer becomes eligible to place a craps wager and roll the dice. Three possible outcomes of the craps roll are permitted. A first outcome based on a roll sum of 7 or 11; a second outcome based on a roll sum of 2, 3 or 12; and a third outcome based on a roll sum of the Point numbers 4, 5, 6, 8, 9 or 10.

U.S. Pat. No. 6,708,974 to Brown describes a method for playing Poker with a craps side bet similar in many respects to that described above in connection with Brown's '192 patent. In this patent, however, a poker player becomes eligible to make a craps side wager in response to the first Dealer down card being a spade. Also, like in the '192 patent, the craps proposition outcomes are not tied to card values, but rather to the roll sum of two dice falling within one of three number groups.

U.S. Pat. No. 5,857,676 to Whitson describes a combination card and dice game based loosely on the combined games of craps and Blackjack. According to this game method, a player chooses to either play cards or dice. Once the decision is made, the Dealer turns over one card which becomes a target card. Then, a pair of dice is rolled. If the roll sum of the dice equals the face value of the target card, the player wins provided they bet on the dice. If the target card is a face card, then the card bettor automatically loses. Dice roll sums of 11 or 12 are automatic winners.

Accordingly, there are no examples of prior art Blackjack style card games offering a side bet based on two rolled dice using familiar craps rules in combination with an unqualified hand consisting of the first two cards dealt a player (or the Dealer).

SUMMARY OF THE INVENTION

The invention contemplates a method for playing a Blackjack card game against a House including a novel side wager which may be either optional or mandatory for players. The novel side wager is referred to variously hereafter as a craps side wager, a craps wager, or simply a side wager. The game method comprises the steps of: providing a game playing surface, a Dealer representing the House, at least one Player, and at least one deck of 52 standard playing cards. Each card in the deck has a face bearing indicia with a corresponding number value 1-11. A side wager is received from the Player. Two standard six-sided dice are provided, each side of each die bearing an indicia having a corresponding numeric value of 1-6. One side of each die is randomly selected, such as by rolling or by other suitable methods. The dice value of the indicia on the randomly selected sides is summed so that it comprises a number between 2-12, inclusive. The side wager is automatically resolved in favor of the Player if the summed dice value is equal to the number 7 or 11. In contrast, the side wager is automatically resolved in favor of the House if the summed dice value is equal to the number 2, 3 or 12. If the summed dice value is equal to the number 4, 5, 6, 8, 9 or 10, then the summed dice value is designated as a Point. The Player is dealt an opening hand of two cards from the deck arranged face up on the playing surface. The Dealer is likewise dealt an opening hand of two cards from the deck arranged one face up on the playing surface. The side wager is resolved in favor of the Player if at least one face up card on the playing surface has a numerical value equal to the Point. Following resolution of the side wager, the Blackjack card game is played according to the traditional rules of Blackjack and with at least some of the same cards used to resolve the side wager.

According to another aspect of this invention, a Blackjack card game against a House including a side wager may be played so as to delay resolution of the side wager until the after completion of the Blackjack card game whenever a Point is established. In this version, the side wager is resolved in favor of the Player if at least one face up card on the playing surface has a numerical value equal to the Point following resolution of the Blackjack card game according to the traditional rules of Blackjack.

According to yet another aspect of this invention, a method is contemplated for a Player to play an electronically implemented Blackjack card game against a House including a side wager, the game method includes the step of providing a non-transitory computer readable medium coded with instructions and executed by a processor to perform the steps of the invention.

The subject invention provides an exciting and easily learned side wager in a card game of Blackjack that will attract new players and maintain the interest of current players. The side wager is easily learned by Dealers and easily managed.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENTS

Figure 1:
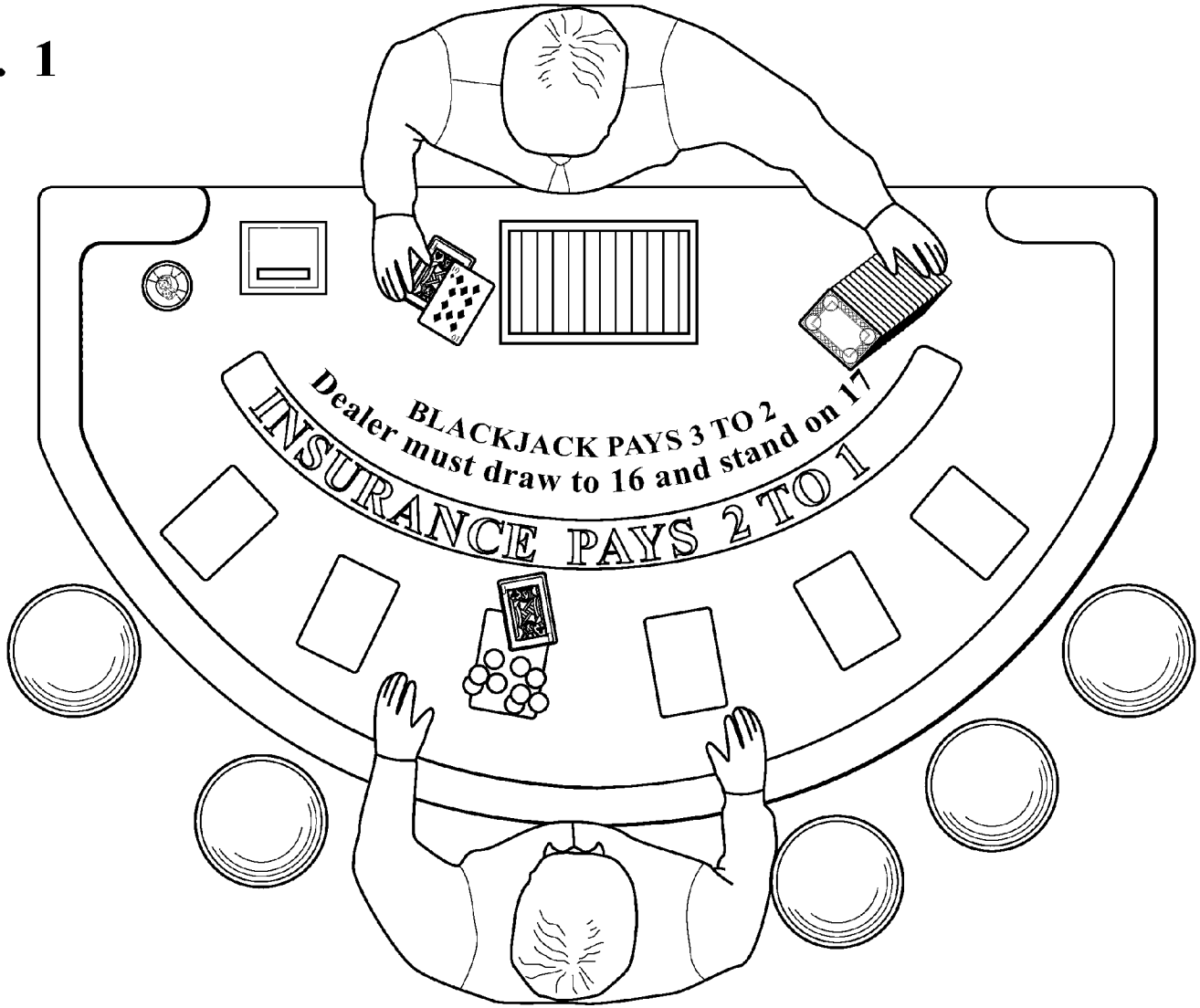
FIG. 1 is a top view of a playing surface for the card game Blackjack including the optional side wager of this invention, and showing a Dealer and a Player and at least one deck of standard playing cards.
Figure 2:
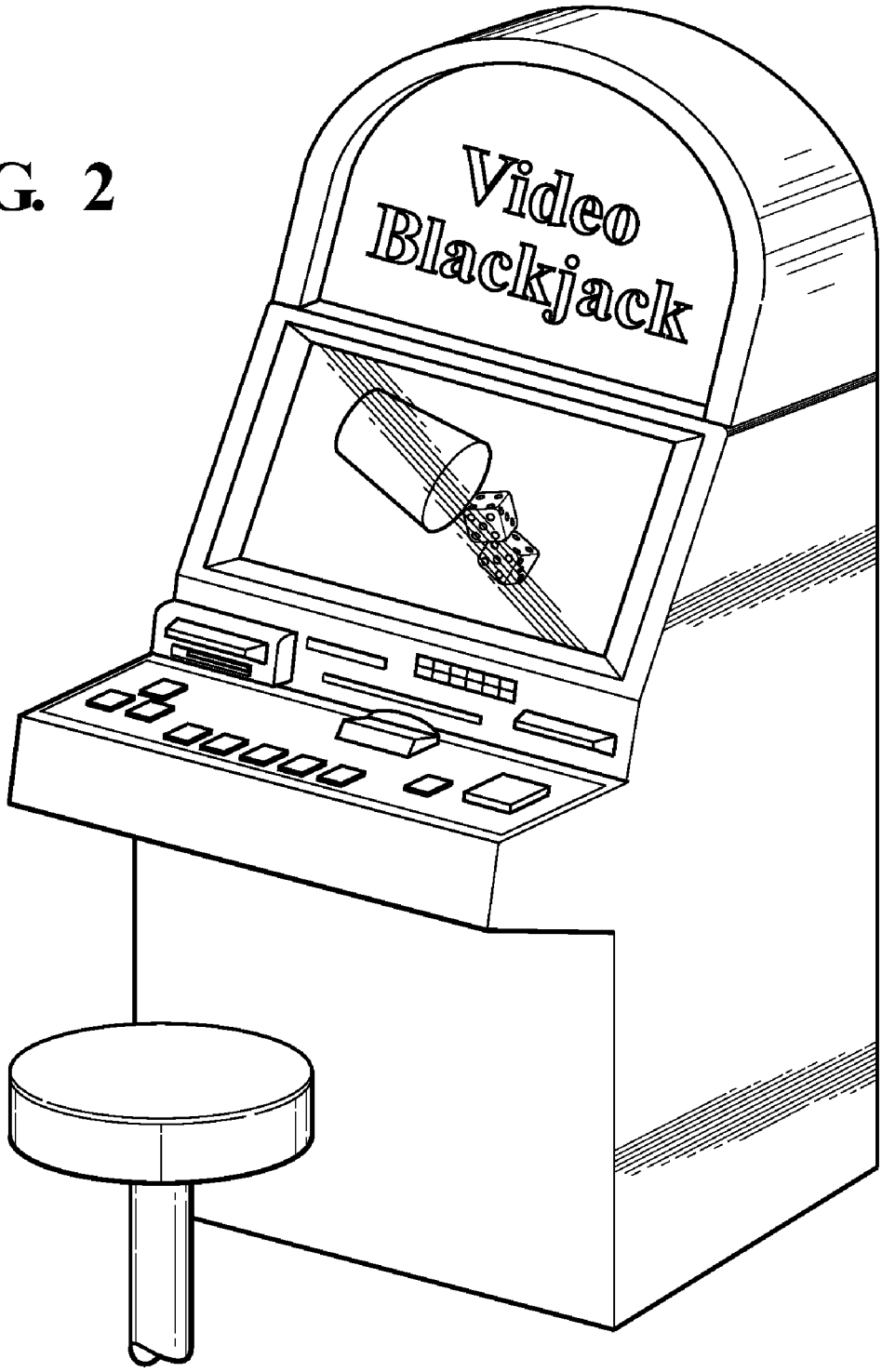
FIG. 2 is a perspective view of an electronic gaming machine that may house a non-transitory computer readable medium coded with instructions and executed by a processor to perform the steps of this invention.
Figure 3:
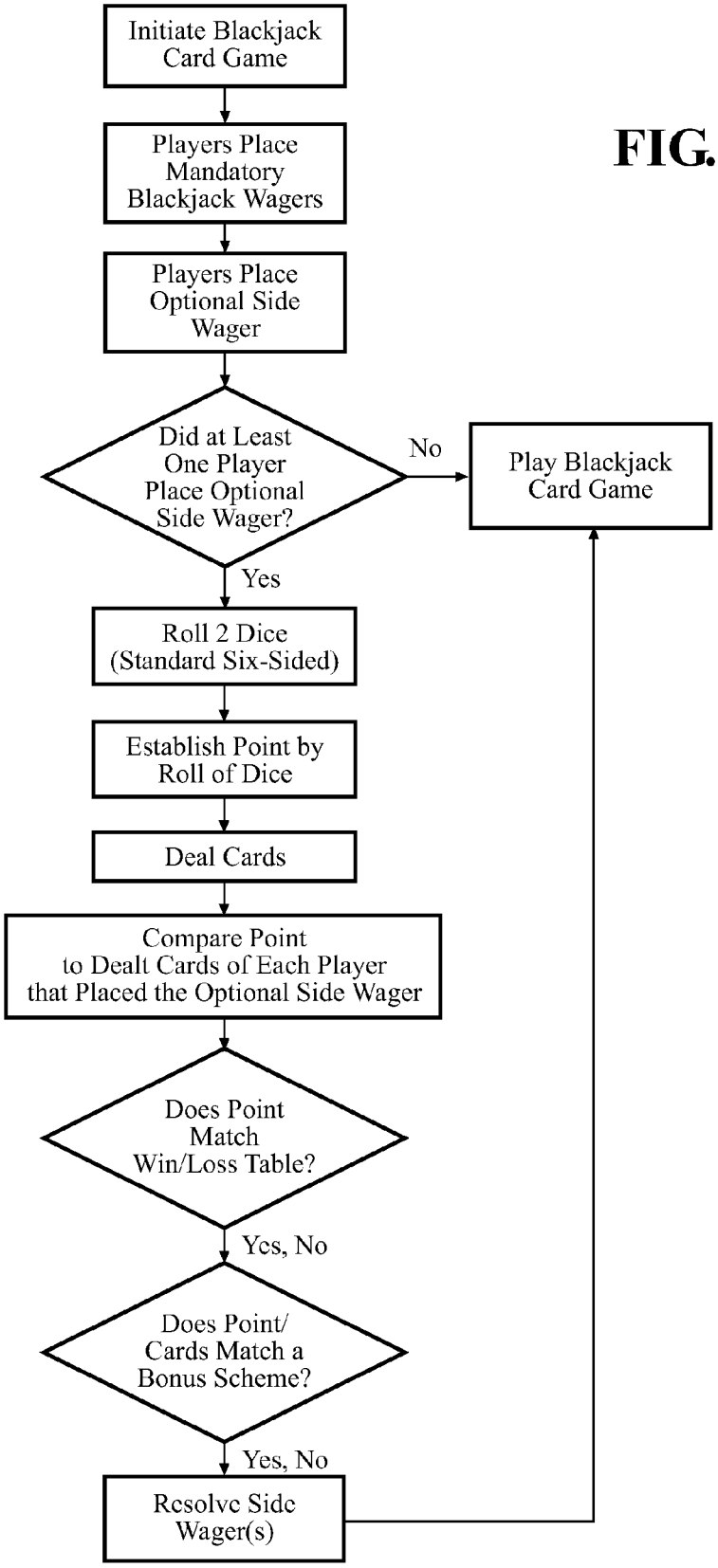
FIG. 3 is a simplified flow diagram describing the methods step of this invention according to one contemplated embodiment.

This invention provides a craps-like side wager to a regular, generally traditional, game of Blackjack, which may be played as a real-life table game with physical cards, or via electronic representations thereof through a computer, gaming terminal, the Internet, or the like. In electronic implementations, the system may include a non-transitory computer readable medium coded with instructions and executed by a processor to perform the steps of this invention as described more fully in the following paragraphs and shown in the drawing figures. The general principle of the game is to play Blackjack as per the traditional method using at least one deck of 52 standard playing cards. The cards each have a face side bearing indicia 2, 3, 4, 5, 6, 7, 8, 9, 10, J, Q, K, A in four suits. The corresponding numeric value of each indicia type is as follows: 2=2, 3=3, 4=4, 5=5, 6=6, 7=7, 8=8, 9=9, 10=10, J=10, Q=10, K=10, and A=1 or 11. The side wager is based on the initial two cards that are dealt to the player, or in one alternative, the initial two cards that are dealt to the Dealer. The side wager is resolved independently of the play of the Blackjack wager, and requires no substantive changes to the traditional rules, play or payouts of Blackjack.

One preferred method of this invention is described with reference to FIGS. 1-8. To start the game, players are invited to take a position at the game playing surface generally facing a Dealer. The game playing surface may be a physical, horizontal table covered in a felt-like materials according to traditional card table implementations, or could be a physical table having a computerized display screen forming a horizontal playing surface, or could be a display screen in a hand-held device or video arcade type machine. The Dealer may be either a live human being, or a computer-generated persona, or a function carried out in a computer-implemented embodiment. At the outset, each player is invited to make two wagers—one for traditional Blackjack and one for the side wager. Based on house rules and mathematical analysis, the two wagers can be of equal or different values, where either the Blackjack or the craps wager may or may not exceed the other. A Point is established by rolling two standard, six-sided die as commonly used in the traditional game of craps. Dice are either rolled mechanically by the Dealer, electronically/virtually by the player or Dealer, or by any method of triggering the dice to roll based on available technology. If house rules allow, the dice may be rolled mechanically by the player. The player's goal is to either roll a 7 or 11, or have either of their cards match the total sum of the numbers on the dice as rolled, while avoiding rolling a 2, 3 or 12 which resolve as automatic losers. The method of determining whether the player's cards match the dice can be obtained from a plurality of options which are described below, and may include the use of the Dealer's cards in one variation.

Winners of the side wager will be paid at predetermined odds. In order to qualify for winning the side wager, the player must have placed the side wager prior to any cards being dealt or dice rolled. Winning wagers for the side wager can be based on a variety of factors. For example, automatic winners are based solely on the outcome of the roll of the dice. As in the Come-Out roll in the traditional game of craps, automatic winners occur when the roll sum of the two dice is 7 or 11, and automatic losers occur when the roll sum is 2, 3 or 12. Players can be paid if 7 or 11 are rolled, and automatically lose if 2, 3 or 12 are rolled. If an automatic win or loss does not occur, a Point is established by the outcome of the dice. Therefore, Points can be established as any of the numbers 4, 5, 6, 8, 9 or 10. (In other variations, the roll sums of 2 or 3 can be treated as Points instead of automatic losers.) When a Point is established, the side wager is won if either one of the player's two initial cards (dealt as per the traditional rules of Blackjack) match the Point. For example, if the Point rolled is a 6, and the player receives card values of 4 and 6, the wager is paid because the 6 value card matches the roll sum 6 (i.e., the Point) on the dice. The 4 value card is not relevant in this instance for resolving the wager.

Figure 4:
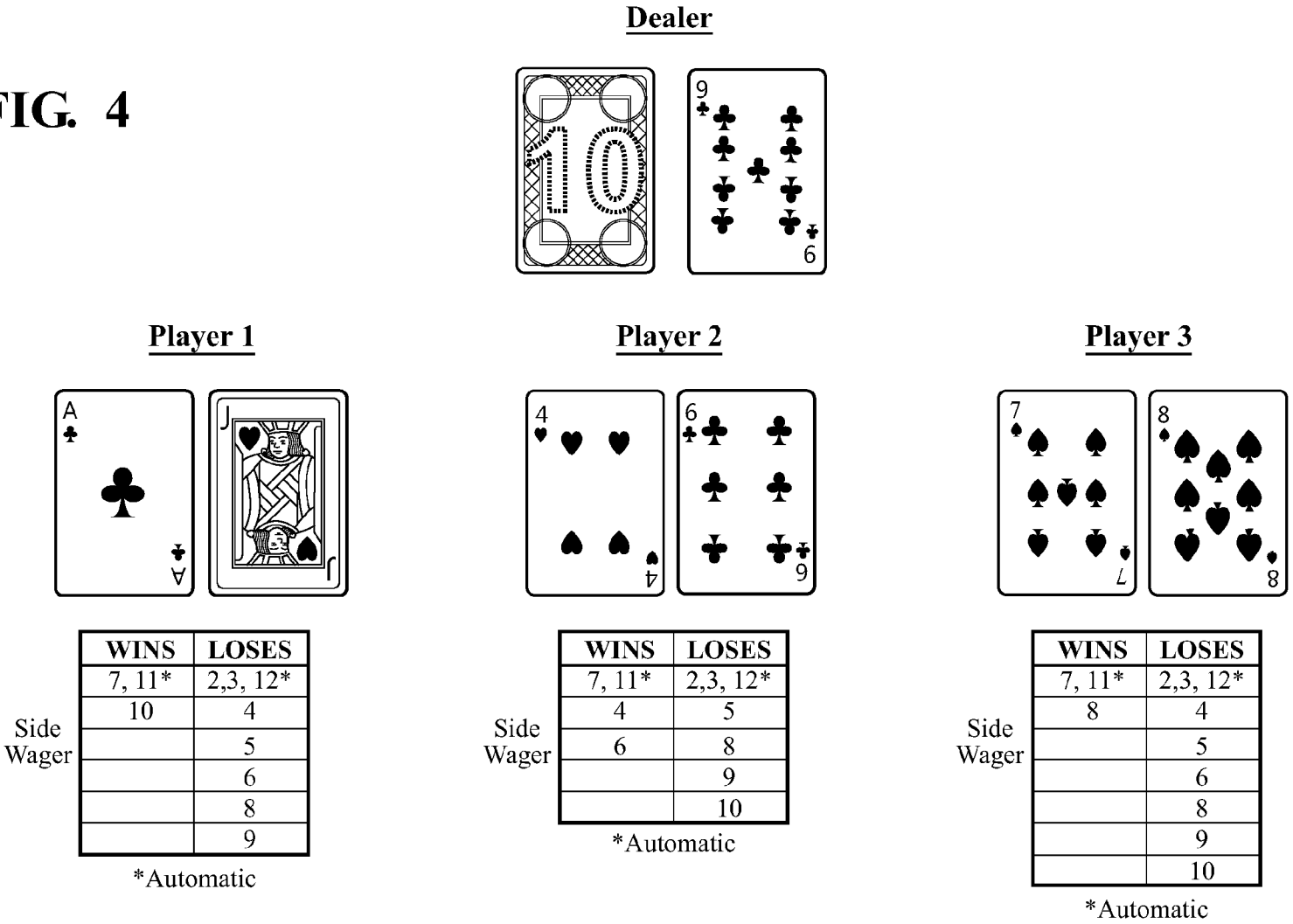
FIG. 4 is a simplified view of an exemplary three-player game played according to one embodiment of this invention wherein Player 1 is dealt an initial two cards A-J, Player 2 is dealt an initial two cards 4-6, and Player 3 is dealt an initial two cards 7-8, and describing in table form the various roll sum combinations which will result in wins or losses for each player, provided they choose make the optional side wager.

FIGS. 4-8 describe the basic game method as outlined above, in the context of three players (Player 1, Player 2, and Player 3) and a Dealer. In these examples, Player 1 is dealt an initial two cards A-J. Player 2 is dealt an initial two cards 4-6. Player 3 is dealt an initial two cards 7-8. FIG. 4 describes, in table form, the various roll sum combinations which will result in wins or losses for each player, provided they make the side wager described herein.

Specific examples are given in FIGS. 5-8. In these examples, it is suggested or presumed that all three players make the side wager prior to being dealt the initial two cards in the game of Blackjack, and that the Dealer or a designated player rolls the dice to resolve the side wager for all players simultaneously. Alternatively, the side wager may be resolved by each player individually rolling the two dice to determine whether their side wager wins or loses.

Figure 5:
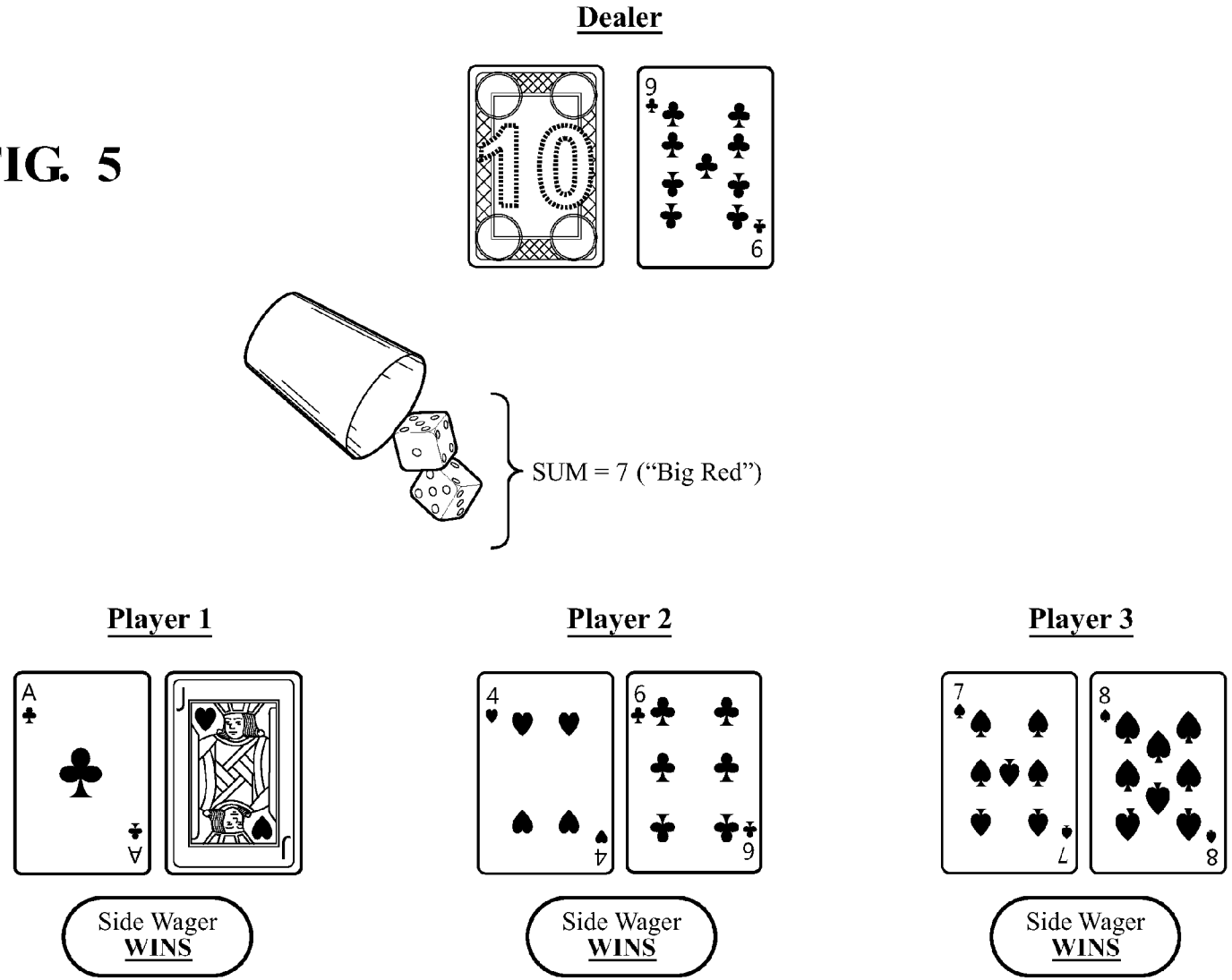
FIG. 5 is a view as in FIG. 4 and representing a scenario where the rolled dice sum equals 7.

In these examples, FIG. 5 represents a scenario where the rolled dice sum equals 7, which is established as an automatic winner as in the Come-Out roll in craps. Thus, Players 1, 2 and 3 win the side wager. If the roll sum had been 11 instead of 7, the same result would have been obtained, because the side wager is resolved as would be the Come-Out roll in the game of craps, with both numbers 7 and 11 resulting in automatic wins.

Figure 6:
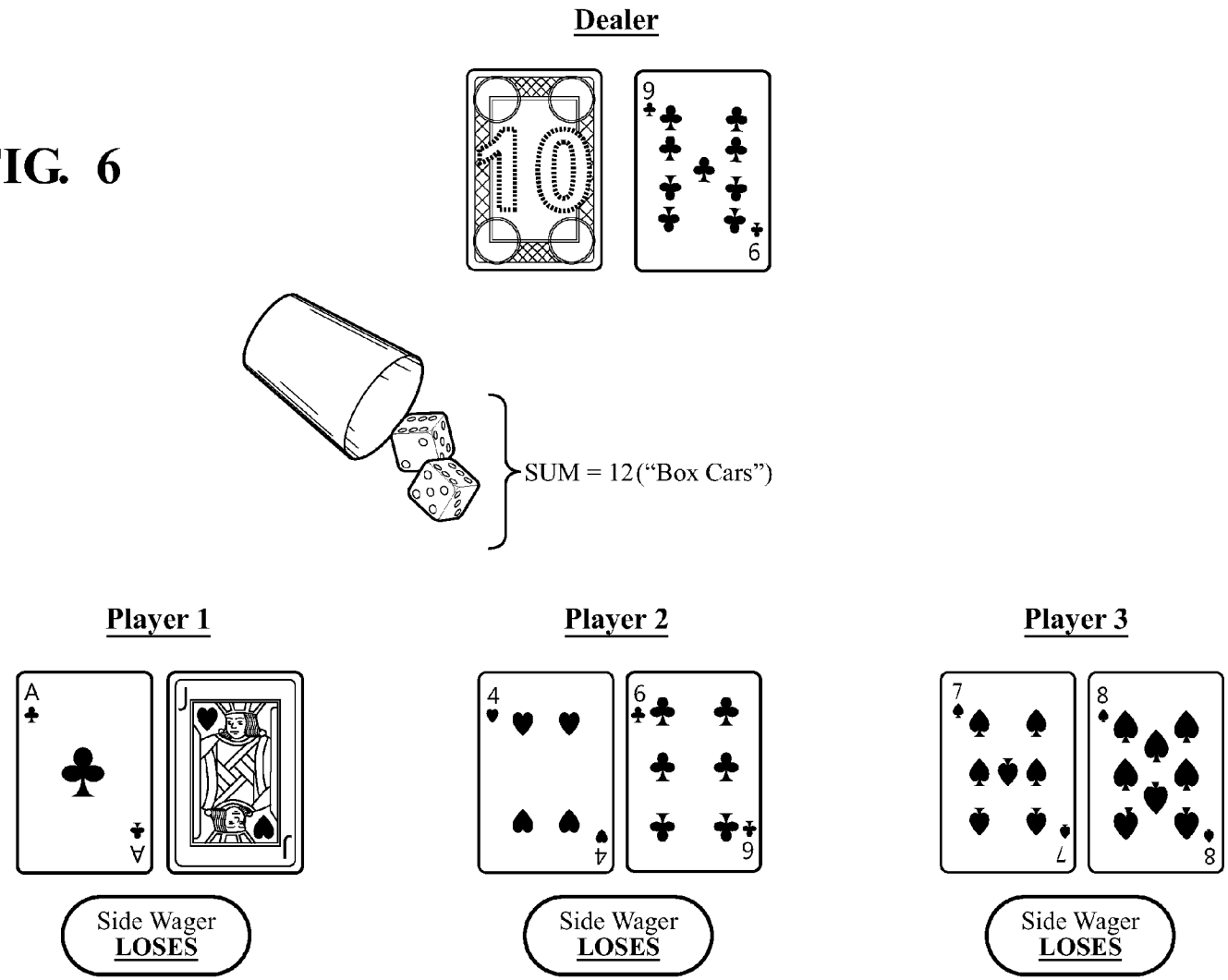
FIG. 6 is a view as in FIG. 4 and representing a scenario where the roll sum of the dice equals 12.

FIG. 6 describes a scenario where the roll sum of the dice equals 12. As in the traditional game of craps, a roll sum of 12 (on the Come-Out roll) results in an automatic loss and the side wagers for Players 1, 2 and 3 are lost as a result. In game play versions where roll sums of 2 and 3 are automatic losers, the same result would be obtained if the roll sum had been 2 or 3.

Figure 7:
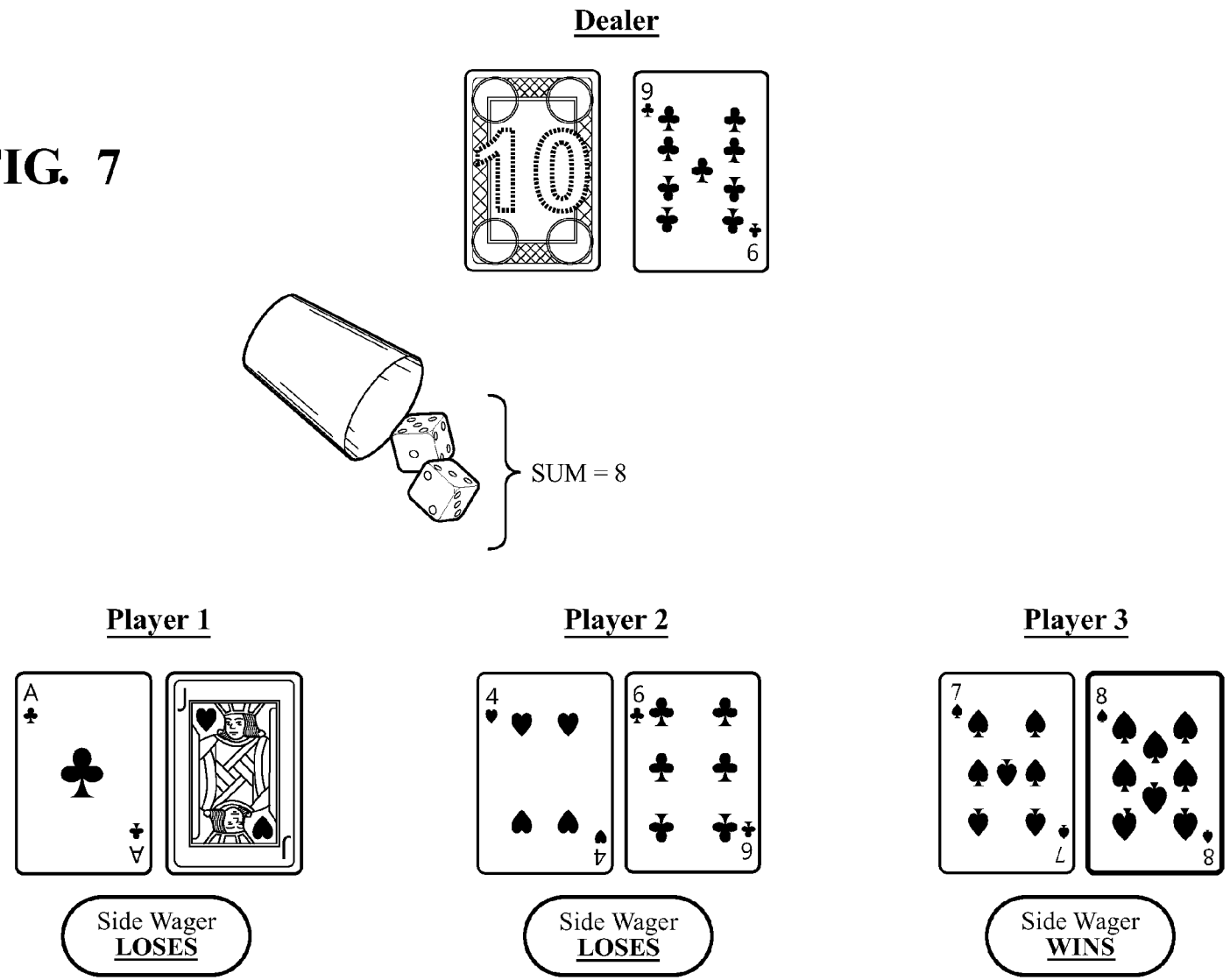
FIG. 7 is a view as in FIG. 4 and representing a scenario in which the Point number 8 and this is the established Point.

FIG. 7 represents a scenario in which the Point number 8 is established by the roll sum of dice as shown. In this case, when a Point is established rather than an automatic win or automatic loss, the player's cards are individually compared to the established Point number. Player 1 loses the side wager because neither of their first two dealt cards (A-J) are an 8. Likewise, Player 2 loses the side wager. Player 3 wins the side wager, however, because one of their dealt cards is an 8. Once the side wager is resolved, play resumes according to the normal rules of Blackjack.

Figure 8:
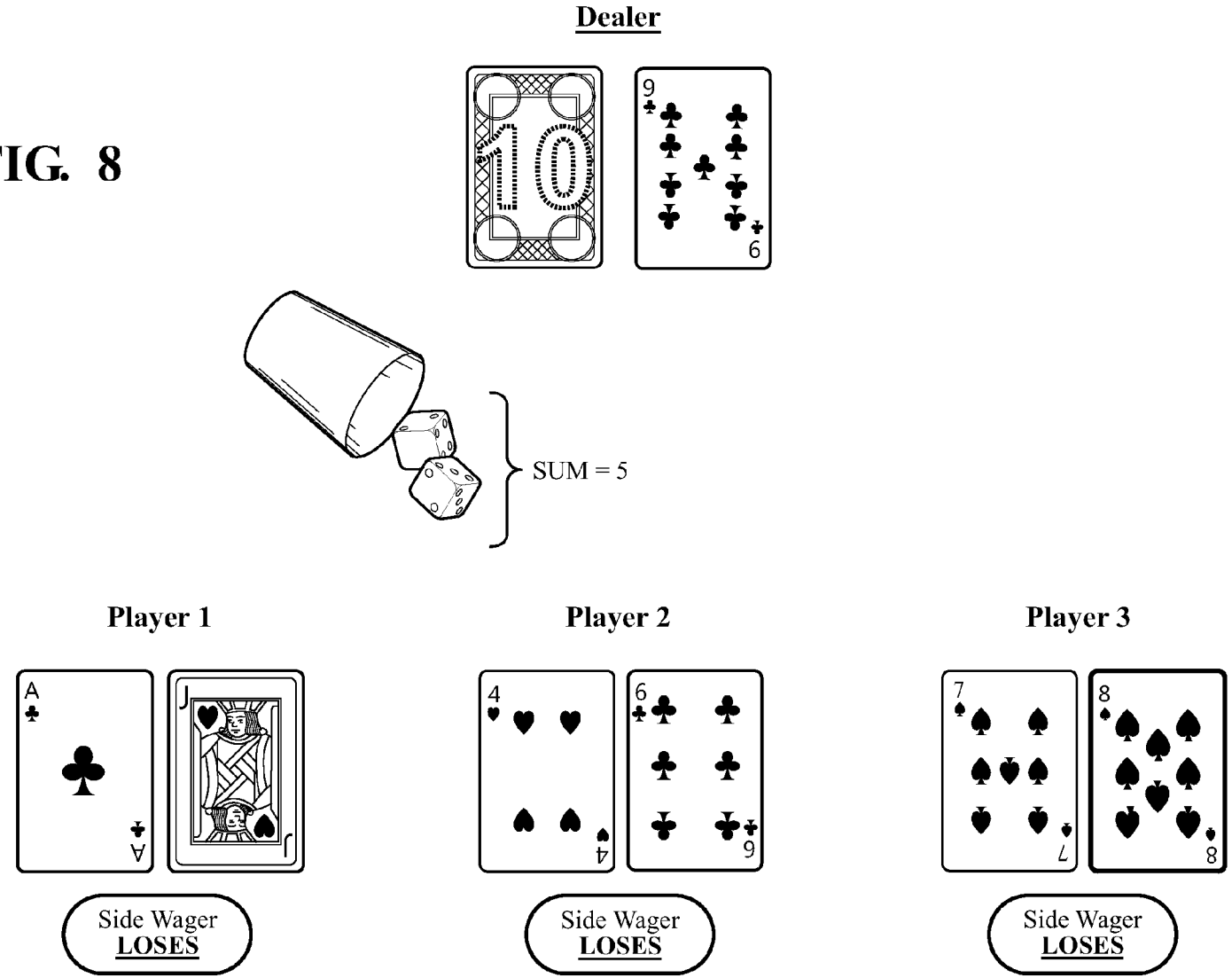
FIG. 8 is a view as in FIG. 4 and representing a scenario in which the roll sum equals 5 and this is the established Point.
Figure 9:
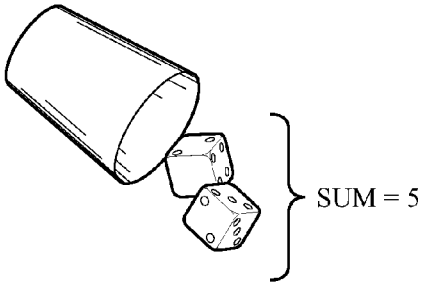
FIG. 9 depicts an alternative scenario in which the established Point is a 5 and the Player is dealt 5-5 thus triggering a special bonus win scenario.
Figure 9:
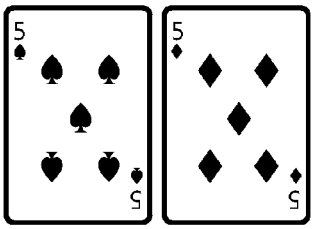
Figure 10:
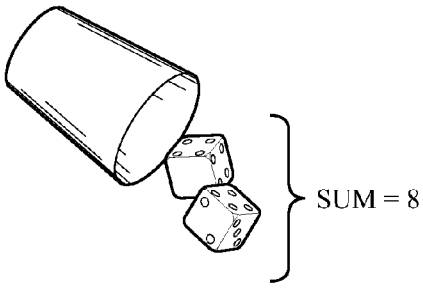
FIG. 10 shows another alternative scenario where a dice roll of double 4's results in a roll sum of 8, and the player is dealt an 8 card thus triggering a special bonus win scenario.
Figure 10:
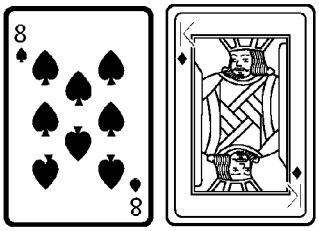

FIG. 8 shows a scenario in which the roll sum equals 5 and this is the established Point. None of the players win the side wager, because none of the players have a 5 value card. Additional bonuses can be paid for card pairs that equal the Point total (FIG. 6A), or the sum of two paired cards that equal the Point total. For example, FIG. 9 depicts a scenario in which the dice roll/Point is a 5 and the player is dealt two 5's. A bonus win scenario may be triggered. FIG. 10 shows a scenario where a dice roll of double 4's results in a roll sum of 8, and the player is dealt an 8 card.

Figure 11:
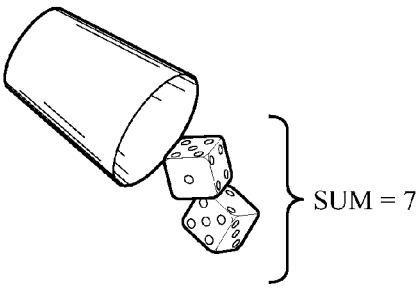
FIG. 11 shows a still further alternative scenario in which a special bonus is triggered if the Player is dealt a 7 and the roll sum is 7 or 11.
Figure 11:
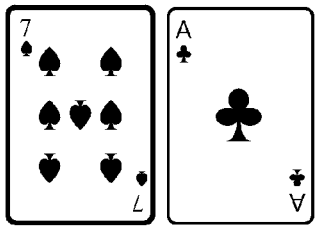

Bonuses may be crafted on any number of principles. In one variation of the game, bonuses are paid automatically if the roll of the dice is any double, regardless of the player card values. In another scheme, a bonus may be triggered if the player is dealt a 7 or an Ace and the roll sum is 7 or 11. See, for example, FIG. 11. In this scenario, the numbers 7 and 11 are automatic winners on the roll of the dice and cannot be Points. However, the player in this example was dealt a 7 card for which there could be no established Point to match. Thus, the player is paid a bonus, on top of the automatic win, for receiving a 7. Equally, an Ace which has a Point total of 11 would result in a similar outcome if the roll sum is 11.

According to a first alternative embodiment of this invention, the side wager may be resolved on the total sum of the two cards that are initially dealt to a player, rather than on the individual face values of each card. According to this embodiment, the first 10 value card (10, J, Q, K) may be assigned a 0 Point value for purposes of calculating the card sum. For example, a King and a 2 would have a card sum of two. A 10 and a 6 would have a card sum of six. Two ten value cards would equal 10, however. All other hands that result in a card sum less than 12 would be counted as is. For example, a 6 and a 4 on the first two cards would be considered a 10. If the established Point were a 10, then the player would win the side wager.

For all hands where the sum of the two initially dealt cards exceeds 14, then 10 would be subtracted from this total to determine the corresponding number to be matched against the Point. For example, if the player is dealt a 9 and an 8, the total would be 17. Since there is not a combination of two dice that can equal 17, 10 would be subtracted from the total which, in this case, would leave 7. Bonuses can be paid for pairs that equal the Point total. Thus, if the established Point were an 8 and the player is dealt two 4's, then this would pay at an extra predetermined bonus.

Figure 12:
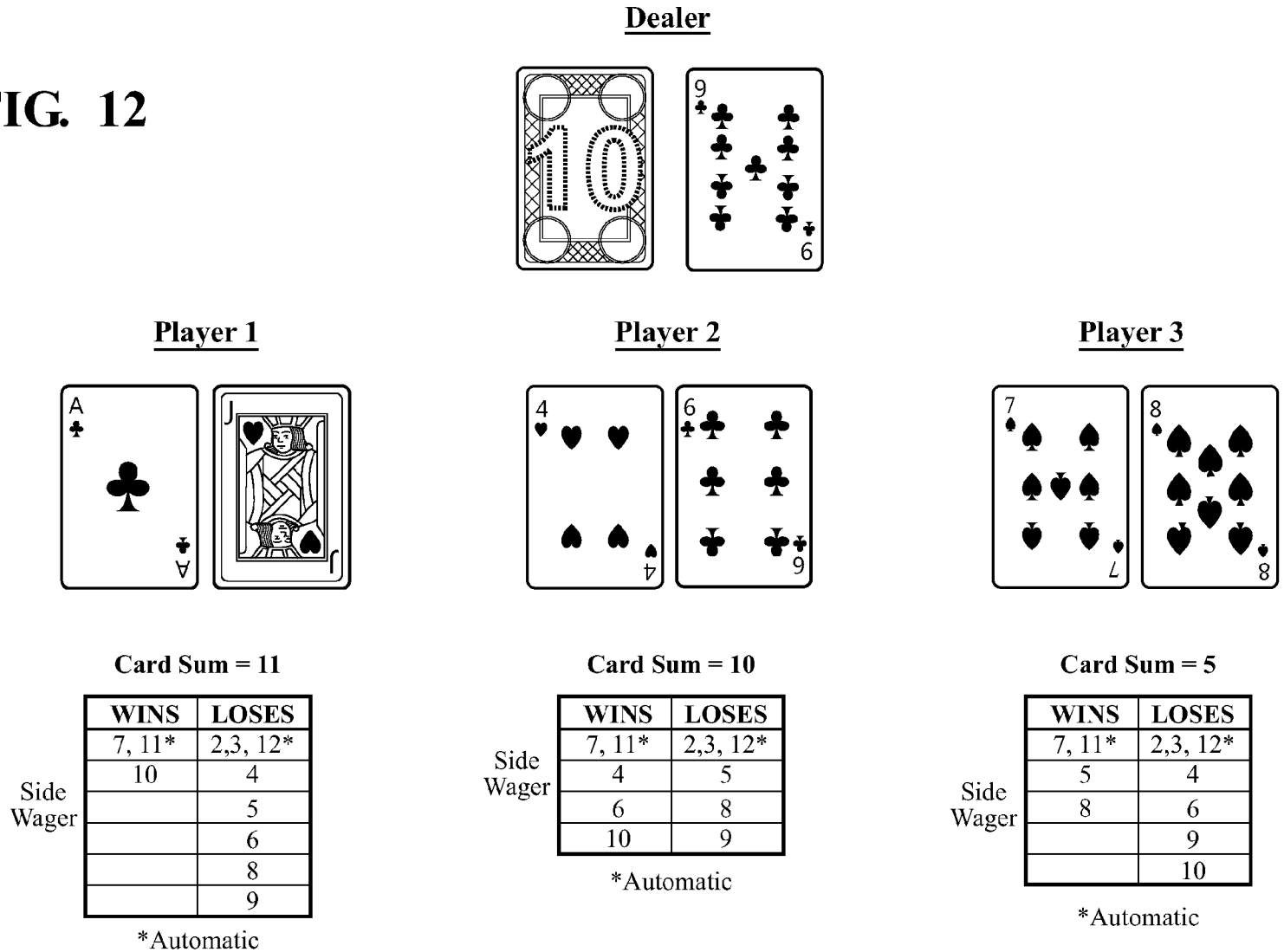
FIG. 12 illustrates another alternative embodiment of this invention wherein the optional side wager may be resolved on the total sum of the two cards that are initially dealt to a Player in addition to the individual face values of each card.

FIG. 12 describes this alternative embodiment wherein Player 1 is dealt a A-J, Player 2 is dealt 4-6, and Player 3 is dealt 7-8. According to these principles, the card sum of Player 1 equals 11 (11+0=11). Aces may also be considered to have a Point value of 1 or 11. The card sum for Player 2 equals 10 (4+6=10). The card sum for Player 3 equals 5 (7+8−10=5). Tables are provided below each player hand in FIG. 12 representing the various dice sums that will result in wins for the respective players based on the two cards dealt. The tables in this example represent a rule set in which each Player card in their opening hand individually and the card sums are compared against the two rolled dice. This would give each player three opportunities to win a Point (that is, in addition to the automatic wins achieved when the Come-Out roll is a 7 or 11). If either of the two initial cards matches the Point, the player wins the side wager. And if the sum of the two cards matches the Point, the player also wins.

In an alternative to the above Point system, 10's may have a value of 10, and Jack, Queen, and King would have a value of zero. Thus, if the player were dealt a 10 and a Queen on their first two cards then this would be considered a 10. If the established Point were a ten, the player would win their side wager.

Figure 13:
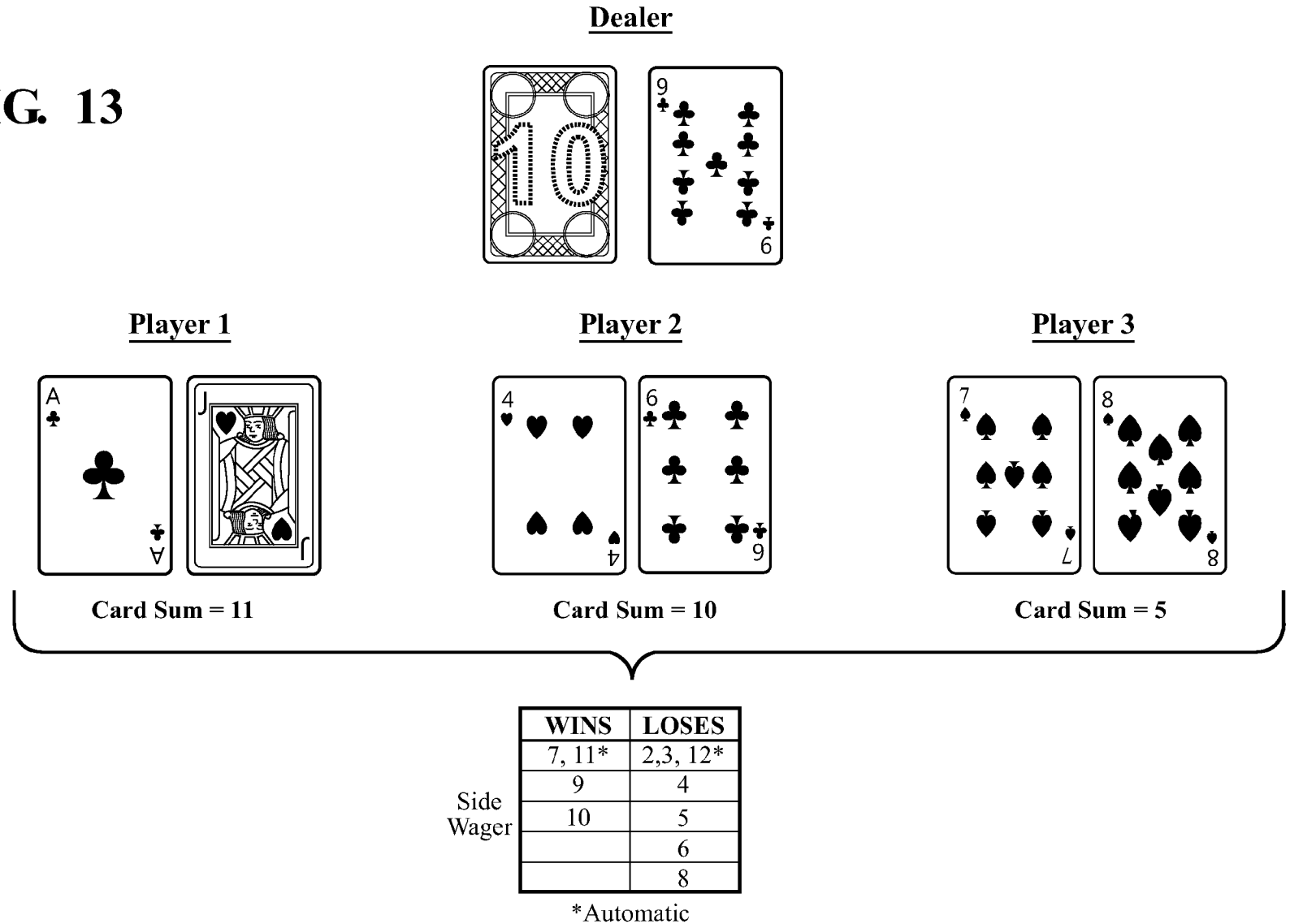
FIG. 13 illustrates yet another alternative embodiment of this invention wherein the optional side wager may be resolved uniformly for all players based on one or both cards dealt to the Dealer.

FIG. 13 shows a second alternative embodiment of the invention, wherein the Dealer's cards are used to determine the outcome of the Point established by the roll of the dice. By using the Dealer's cards to determine the outcome of the craps side wager, the community aspect of the game of craps is adapted to the current craps side wager. This particular implementation can be carried out in a variety of ways. In one approach, the value of the Dealer's exposed or up card is used exclusively to resolve the side wager. In using the Dealer's up card only, the game of Blackjack retains to a large degree its natural fluidity as the craps side wager can be resolved immediately after the opening hands are dealt, but before the play of the Blackjack hand commences. In this example, the Dealer has cards of 9 and 10. In the event that the Dealer's up card is a 10, and if the Point rolled by the dice is 10, then all players who place the side wager would win. All players would lose if the Come-Out roll was a 2, 3, or 12, or lose/push if the established Point was a 4, 5, 6, 8 or 9. A similar result would occur if the established Point were 9, and 9 was the Dealer's up card, or if a 7 or 11 were thrown on the Come-out roll. All players would lose if the Come-Out roll was a 2, 3, or 12, or lose/push if the established Point was a 4, 5, 6, 8 or 10.

Alternatively, both cards in the Dealer's opening hand can be used to compare against the Point established by the roll of the dice. In this approach, the side wager must be resolved at a later time when both cards in the Dealer's opening hand are exposed. In this example, the Dealer has cards of 9 and 10. Thus, if a Point rolled by the dice is 10, then all players who had previously placed the side wager would win. A similar result would occur if the established Point were 9, or if a 7 or 11 were thrown on the Come-out roll. All players would lose if the Come-Out roll was a 2, 3, or 12, or lose/push if the established Point was a 4, 5, 6, or 8.

Yet another variation of this game, not illustrated in the drawings but easily appreciated by those of skill in the field, the side wager is resolved on the basis of all a player's cards that are obtained through the resolution of their Blackjack hand, according to the traditional rules of Blackjack. In this case, unless the Come-Out roll is a 2, 3, 7, 11 or 12, the side wager cannot be determined until the end of Blackjack play. Whatever cards the player adds to his or her hand by the process of "hitting" as per the traditional rules of Blackjack may be included in determining the outcome of the side wager using any combination of the methods above. For example, if the Point established is a 4 and the player is dealt a 10 and a 2 initially, but later hit and received a 4 card, they would win the side wager. Naturally, many variations of this basic side wager may be carried out within the context of the rules as described herein.

In a still further alternative embodiment, the game method can be structured to intentionally incorporate the community aspect of the game of craps into a Blackjack card game via the novel side wager of this invention. In traditional craps, a community element arises if a player rolls the established Point before a seven. When this happens, all players betting on the Pass Line (i.e. betting the player will roll the Point before a seven) win. This concept can also be applied to the current invention. For example, three Players place the craps side wager. The Come-Out roll establishes a Point of 4 and one players that placed the side wager is dealt a four, thereby matching the Point. Subsequently all players who placed the craps side wager could also win.

As described above players may win the craps side wager by a variety of methods. It may be equally beneficial to mention the plurality of outcomes that would result in a player losing the side wager. Scenarios in which the player would lose the craps side wager would be based on the result of the Come-Out roll as indicated above. Rolls of 2, 3, and 12 would be considered automatic losers. Thus, loses on the Come-out roll occur before a Point is established. Players may place a second wager at this time to participate in the next roll of the dice.

In some of the preceding embodiments, a player may automatically win if they are dealt a seven, either as a individual card or as the sum of their two cards. However, in a still further alternative variation to the methods of this invention, player's may instead lose by receiving a card having a face value of seven, or the sum of cards dealt is seven. This is referred to hereafter as Sevening-Out, and is loosely akin to a craps player rolling a seven before re-rolling the Point in the traditional game of craps. In adapting this principle to the novel side wager of this invention, players may Seven-Out and lose the side wager if: 1) The player is dealt two cards which when summed together total 7; 2) The player is dealt a seven as one of their two initial Blackjack cards; or 3) If in the course of completing their Blackjack hand the player receives a seven in a card dealt after the two initial cards. Taking each of these in turn scenarios, a loss may occur when the player is dealt two cards which when summed together total 7. (In this instance ten valued cards (10, Jack, Queen, and King) would have a value of zero; and Aces would have a value of 1). For example, an initial two card Blackjack hand of King and 7; or 4 and 3, or Ace and 6 would all be instances in which the player's first two cards total seven resulting in an automatic loss of the craps wager. In the second instance, the player may lose by receiving a seven as one of their two initial Blackjack cards. For example, a two card hand of Blackjack dealt as King and 7; or a 2 and 7 would be automatic losers in regard to the craps wager as both hands contain a face-value 7 card. In the third instance, the player may lose if, in the course of subsequently completing their Blackjack hand, the player receives a card having a face-value of 7. For example, if the player has a two card total of sixteen (i.e. 10 and 6 for example), they may choose to draw a card (i.e. hit, to better their Blackjack hand). If the player draws a seven then that player would lose their craps side wager.

In other variations of the game, losing hands for the craps side wager could also be determined through the Dealer's cards. By using the Dealer's cards, a community aspect could then be incorporated, and a plurality of methods can result in the player losing their craps wager, whereby if the Dealer Sevens-Out all players would lose their craps wager. This would be akin to the traditional game of craps when players bet on the Pass Line. The outcome of each participating player's side wager could be: 1) Based solely on the Dealer's up card; 2) Based on the sum of the Dealer's first two cards; or 3) Based on any of the Dealer's cards when their hand is complete. Considering each option in turn, if the Dealer's single exposed card is a seven then all participating players would automatically lose the side wager. Here, the craps wager would be resolved before Blackjack is played. Methods in which the craps wager is resolved before Blackjack is played may be preferred as they preserve the natural fluidity of the Blackjack game. When a side wager decision is based on the sum of the Dealer's first two cards, any ten valued card would have a Point value of zero. Therefore a hand of Jack and 7; or 5 and 2 would be considered automatic losers for the player that made the side wager. The wager could not be resolved until after the player's Blackjack hand is played, and may as a result slightly disrupt the fluidity of the Blackjack card game. When the side wager decision is based on any of the Dealer's cards when their hand is complete, a side wager resolution cannot be reached until after the Dealer's Blackjack hand is played. For example, if the Dealer has a two card sum of sixteen (i.e. 10 and 6 for example), in most casino's the Dealer would need to draw a card as per the standard rules of Blackjack (i.e., that require the Dealer must hit all hands below seventeen). If the Dealer were to draw a seven then all participating players would lose their craps side wager. All of the above-described methods of Sevening-Out can be combined or played individually.

For those skilled in the art, it will be apparent that the methods above are not meant to be an exhaustive list, but are demonstrative of the manner in which the player's and/or Dealer's cards can be used in determining the outcome of the craps side wager.

According to the methods described above, the craps side wager is considered complete after each round of Blackjack, whether or not the Point is made. However, in an alternative implementation, the side wager may continue into the next round of Blackjack through a plurality of methods which can include: until all players Seven-Out or the established Point is matched by at least one player. According to this latter embodiment, if at least one player's cards match the Point, the craps round would end at the end of that round of Blackjack. A new round would begin through rolling the dice until a Point is established, and then the next round of Blackjack would be dealt. If no player matches the Point, and all players do not Seven-Out, the craps side wager will push and the same Point will remain in place for the next round of Blackjack. If an individual player Sevens-Out based on their own cards before the Point is made, the craps wager is collected from that player, and the player may place a new craps wager may at the beginning of the next round of Blackjack, trying to match the same previously established Point.

Figure 14:
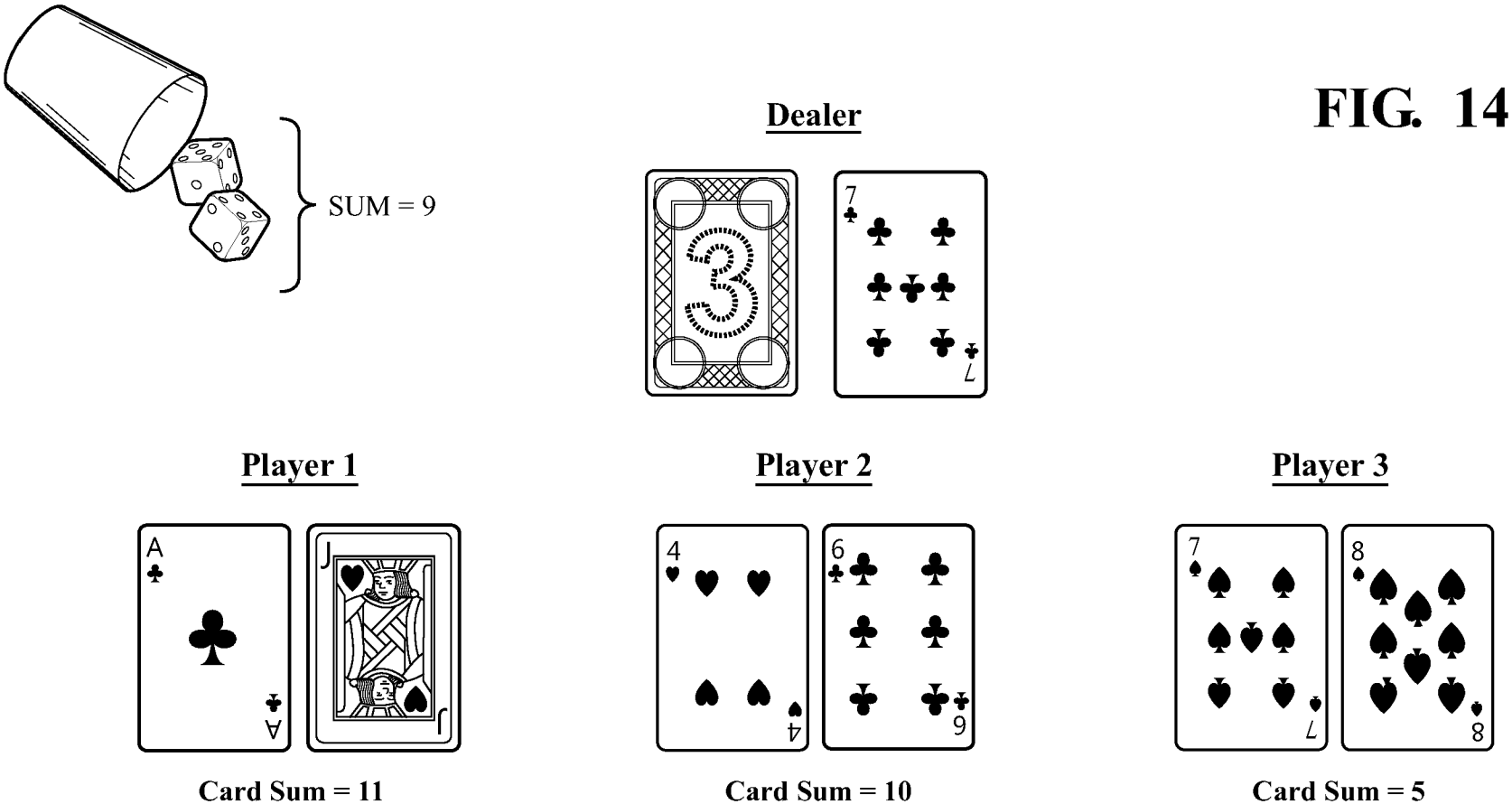
FIG. 14 shows a still further alternative scenario used to describe certain alternative methods for playing a game of chance according to the methods of this invention.

For example, as shown in FIG. 14, a game according to this invention may be played in which the established Point is a 9 (assuming that Come-out rolls of 7 and 11 would be automatic winners, and 2, 3 or 12 can either be Points or automatic losers as described above). Player 1 is dealt an initial two cards A-J. Player 2 is dealt an initial two cards 4-6. Player 3 is dealt an initial two cards 7-8. The Dealer's cards are shown as 3-7, and may or may not be used in determining the outcome of the wager as described in certain of the variations above. In this case, Player 1 would neither win nor lose as their cards did not match the Point of 9 nor did they result in the player Sevening-Out. Here, their craps side wager would push. The same outcome would occur for Player 2 as their cards neither matched the Point nor resulted in them Sevening-Out. Player 3 however, would lose their craps side wager as they were dealt a card having a face value of seven—i.e., they Sevened-Out. After the round of Blackjack is complete, all players with active craps side wagers would again be trying to match the established Point of 9 when the next round of cards are dealt. Thus, the dice would not be rolled. Player 3 would be able to place a new craps wager trying to match the established Point of 9, as they lost their craps wager in the previous round of Blackjack when they were dealt a 7 card. The game would continue, and the dice would not be rolled again until at least one player matches the Point (9 in this example) or all players Seven-Out in the same round. This method is particularly appealing as it keeps the fluidity of the game of Blackjack in place, by creating fewer interruptions caused by repeatedly rolling the dice. Additionally, allowing the side wager to push if the Point is not made, rather than resolving in favor of the House, gives players more opportunities to win the side wager.

In game methods that do not include the immediately preceding variation, the craps wager is completed after each round of Blackjack is complete whether or not the Point is made. Returning to the scenario described in FIG. 14 where the established Point is a 9, Player 1 is dealt an initial two cards A-J; Player 2 is dealt an initial two cards 4-6; and Player 3 is dealt an initial two cards 7-8. All three players are participating in the side wager. In this case, Player 1 loses their craps wager because their cards (A-J) did not match the Point of 9 (and the come-out roll was not 7 or 11). The same outcome would occur for Player 2 as their cards also so not match the Point of 9. Player 3 also loses their craps side wager as they were dealt a seven, resulting in an automatic seven-out. As a result, all craps wagers would be collected by the Dealer. The Players would be invited to place a new craps wager after the round of Blackjack is complete and before the next round begins. The Point of 9 may stay active as the "Point" into the next round of Blackjack, or alternatively the dice are re-rolled to establish a new Point. Either approach may be used, depending on established house rules. In this method of play, Points would be made less frequently and can be paid at higher odds. Alternate pay tables may be constructed. Such pay tables may include the number of players placing the craps wager, as the more players there are, the more likely the Point will be made.

Attention must also be paid to whether or not a Player may "take down" a previously placed craps side wager (i.e. remove their craps wager from the table after it is placed at a time before the wager would normally be resolved). In the preferred embodiment, players will not be able to remove their craps wager until the round of craps is complete. A complete round of craps as it pertains to the current invention includes the steps of 1) rolling the dice on the Come-Out roll until a Point is established, 2) playing Blackjack until at least one player matches the Point, and/or 3) the Dealer's cards match the Point and/or 4) all players Seven-Out.

In the traditional game of craps, players are generally not permitted to place a Pass Line wager, and then take the wager down (i.e. not complete the round of craps) before the Pass Line wager is resolved. This procedure is in place to protect the house. Player's would have an unfair advantage if they could simply place their money on the Pass Line and wait for a roll on a 7 or 11 to win the wager, or take the wager off the table in the event a Point is established on the Come-out roll. Accordingly, of the thirty-six possible combinations produced by the roll of two six sided die, player's would win or push their wager in thirty-two instances as there are only four ways to roll a 2, 3, or 12 (i.e. 1,1; 1,2; 2,1; 6,6), clearly giving a large edge to the player if they could take down their wager at anytime. The preferred method of play of the subject game adopts a similar, craps-like, procedure to a side wager played in the context of a Blackjack game as indicated directly above. Thus, once a craps side wager is placed, a Point would need to be established and resolved before the Player could take down their craps side wager.

Given that the win frequency of the craps side wager will be limited in general, scenarios could be developed (i.e. through adjustment of pay tables) whereby a Player would be permitted to take down their craps side wager after a round of Blackjack ends even though their craps side wager is unresolved. Thus, in the situation where the Player's Blackjack bankroll is depleted, or they would like to leave the Blackjack table when their craps side wager has not been resolved, they may be able to take their craps wager back, thus giving the player more freedom to leave as they would not be receiving any cards. Again this would occur after their round of Blackjack is complete. If the Dealer's cards were used to determine the outcome of the side wager, then the Player may opt to keep their craps wager in play and use the Dealer's cards to potentially win their wager.

Dice rolls may be limited to the Dealer in all instances, or alternatively permitted to the players in turn. If to the players, it may be preferable to allow a player that makes the established Point to roll the dice in the next round of play. That player may continue to roll the dice in successive rounds of play so long as they continue to make the Point. If they do not make the Point or Seven-Out, the player to their immediate left is offered to roll the dice, thereby mimicking the traditional rules of craps.

In the event the player has made the Point but the Dealer's cards result in the player Sevening-Out, then the craps wager can win, lose, or push depending on house rules and mathematical analysis. If one of a player's card matches the Point but their card sum total equals seven (e.g., Point of 4 and player is dealt an 3-4) the craps wager would either win, lose, or push depending on house rules informed by suitable mathematical analysis.

Variations can also be constructed in which the player's craps wager will be independent of the Dealer having a Blackjack, or conversely the player would also lose their craps wager if the Dealer has a Blackjack. When players lose their craps wager due to a Dealer Blackjack, players will be offered insurance for both their Blackjack and craps side wager when the Dealer's up card is an Ace. Insurance may be paid and played as per the traditional rules of Blackjack.

An example of how the combined rules can be formatted to a particular game is described in the following paragraphs. All Players participating in the side wager will win if the Come-Out roll is a 7 or 11. In the case where a Point of 4, 5, 6, 8, 9, or 10 is established on the Come-Out roll, participating players will win the craps side wager if: 1) Their first Blackjack card matches the Point, and/or 2) Either of their individual Blackjack cards matches the Point, and/or 3) The sum of their two cards matches the Point (assuming Jack, Queen, and King have a value of zero), and/or 4) The Dealer's up card matches the Point. If a single player wins all other players at the table will have their craps wager returned.

All participating Players will lose or push depending on house rules and mathematical analysis if the Come-Out roll is a 2, 3, or 12. In the case where a Point of 4, 5, 6, 8, 9, or 10 is established on the Come-Out roll players will lose the craps side wager if: 1) Either of the two cards they are initially dealt is a seven, and/or 2) The total sum of their two cards is a seven, and/or 3) The Dealer's up card is a seven.

The craps side wager may continue to the next round of Blackjack (i.e. a new Point will not be rolled) in the event no player makes the Point, and if not all of the Players Seven-Out. In these conditions, successive Blackjack rounds are dealt until either at least one player makes the Point or all players Seven-Out in a single round. If a player Sevens-Out and the Point is not made by any players, the player who Sevened-Out may be invited to place a new craps side wager before the beginning of the next round of Blackjack and thus again to try matching the established Point in the next round of Blackjack play.

In one variation of the game, all players automatically win if the Dealer's up card matches the established Point. By way of example, continuing still with the above established rules/method of play, one may assume that a Point of 4 is rolled on the Come-out roll (via mechanical or electro-mechanical or electronic or virtual methods as described above). Here, the cards are dealt whereby Player 1 is dealt K-K, Player 2 is dealt 9-6, and Player 3 is dealt 10-2. The Dealer reveals their up card which is a 3. It may be assumed that all three players have placed the side wager. In this example, no player automatically wins or loses the craps wager, therefore the craps wager stays in place and the Dealer completes the round of Blackjack as per standard rules. After all Blackjack wagers are resolved, the Dealer deals the next round of Blackjack with the established Point still being a 4. Again, since no player made the Point on the previous round, and not all players Sevened-Out, the dice are not rolled again before the subsequent round of Blackjack is dealt. This keeps the fluidity of Blackjack in place.

Continuing in this same example with all three players having previously placed the side wager and the Point having been previously established as 4, in the next new round of Blackjack Player 1 is dealt a 4-3 (note card sum total of 7), Player 2 is dealt a 7-6, and Player 3 is deal an A-3 (note card sum total of 4). Player 1 and Player 2 both Seven-Out. Player 1 automatically loses their original craps side wager (placed in the preceding round of play) because the sum total of their two cards is seven. Player 2 also loses their original side wager as one of the two cards they were dealt is a seven. However, Player 3 wins their craps side wager because the sum total of their two cards, Ace and 3 (with an Ace being given a value of one), matches the Point of four. The Dealer would collect the craps wagers from Players 1 and 2 (on behalf of the House), and pay Player 3 as per an established pay table. The Dealer would complete the round of Blackjack for all players.

Continuing in this same example, after the just-described Blackjack round is completed, all Players would be invited to make a new craps side wager. Dice will be rolled, perhaps by the Dealer, perhaps by the Player to the left of the Player who rolled during the previous round if that player Sevened-Out. In the latter case, if Player 3 (i.e., the player that made the Point in the previous round) was the person that rolled the dice two games prior that had established the four Point, then Player 3 may be permitted to continue rolling until they Seven-Out as per the traditional rules of craps.

The subject invention provides an exciting and easily learned side bet in a card game of Blackjack. The side bet is placed before any cards are dealt, and can take several variations. In one basic form, game play begins with all players making a blackjack wager, and all players being invited to make a separate, craps side wager. If at least one player has made the craps side wager, the Blackjack game is temporarily suspended while the craps side wager is resolved. Two dice are rolled. If the sum of the two rolled dice is 2, 3 or 12, the side bet is automatically lost similar to the Come-Out roll in the game of craps. If the sum of the two rolled dice is 7 or 11, the side bet is automatically won. Automatic wins and losses based on the Come-Out roll (7, 11, 2, 3, 12) may be resolved before any cards are dealt as the outcome of the wager is solely determined by the roll of the dice and is independent of dealt cards. If the Come-Out roll results in an automatic win or loss (i.e., the dice roll sum is a 7, 11 or 2, 3, 12), then the side wager is resolved for those participating players. All players may at that time be invited to place a new side wager. If instead of an automatic win or loss, the dice roll results in a sum of 4, 6, 8, 9 or 10, this number becomes an established Point. Then, like in traditional Blackjack, each player is dealt two initial cards. Winning or losing the side bet is based on the sum of two rolled dice in relation to the first two cards dealt to the player who has made the side wager. The player(s) participating in the side wager wins the side bet if one of their dealt cards has a face value equal to the Point, or if the sum of their cards equals the Point.

In one variation of the game, dice roll sums of 2 and 3 are considered Points rather than automatic losers/craps. Several other variations on the basic game method are also possible. According to another variation, instead of (or in addition to) determining a Point-based win on the value of any one player card equaling the Point, it can be based on the summed value of both player cards. In this variation, the first "ten" value card is deemed to have a "zero" Point value for purposes of the side wager, and card sums greater than fourteen are reduced by ten. According to yet another variation, the side wager may be resolved based on the Dealer's initial up card (or on the Dealer's first two cards when both are revealed) rather than the player's first two cards. Still further variations are proposed.

The invention may be implemented as a live table game in conjunction with the card game Blackjack, or in electronic implementations were the cards, playing surface, dice, etc. are simulated on a display screen through the action of a non-transitory computer readable medium coded with instructions and executed by a processor to perform the steps described above.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method for a Player to play an electronically implemented Blackjack card game against a House including a side wager, said game method comprising the steps of:

providing a non-transitory computer readable medium coded with instructions and executed by a processor to perform the steps of:

generating a visual representation of a game playing surface;

generating a visual representation of a Dealer station and a Player station adjacent the playing surface;

generating a visual representation of at least one deck of 52 standard playing cards, each card in the deck having a face bearing indicia with a corresponding number value 1-11;

receiving from the Player a side wager;

generating a visual representation of two standard six-sided dice, each side of each die bearing an indicia having a corresponding numeric value of 1-6;

randomly selecting one side of each die;

summing the dice value of the indicia on the randomly selected sides, the summed dice value comprising a number between 2-12, inclusive;

automatically resolving the side wager in favor of the Player if the summed dice value is equal to the number 7 or 11;

automatically resolving the side wager in favor of the House if the summed dice value is equal to the number 2, 3 or 12;

if the summed dice value is equal to the number 4, 5, 6, 8, 9 or 10, then establishing the summed dice value as a Point;

dealing the Player an opening hand consisting of two cards from the deck, arranging each card face up on the playing surface;

dealing the Dealer an opening hand consisting of two cards from the deck, arranging one of the cards face up on the playing surface;

resolving the side wager in favor of the Player if at least one face up card on the playing surface has a numerical value equal to the Point; and continuing play of the Blackjack card game according to the traditional rules of Blackjack.

2. The method of claim 1, further including the step of automatically resolving the side wager in favor of the House if at least one card if at least one face up card on the playing surface has a number value of 7.

3. The method of claim 2, further including the step of summing the card values of both cards in the Player's opening hand, and automatically resolving the side wager in favor of the House if the Player's summed card value is equal to 7.

* * * * *